US006876269B2

(12) United States Patent
Komai et al.

(10) Patent No.: US 6,876,269 B2
(45) Date of Patent: Apr. 5, 2005

(54) NONRECIPROCAL CIRCUIT ELEMENT HAVING EXCELLENT SIGNAL TRANSMISSION EFFICIENCY AND COMMUNICATION APPARATUS USING SAME

(75) Inventors: Eiichi Komai, Niigata-ken (JP); Hiroki Sato, Fukushima-ken (JP); Hitoshi Onishi, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 80 days.

(21) Appl. No.: 10/627,248

(22) Filed: Jul. 25, 2003

(65) Prior Publication Data

US 2004/0041647 A1 Mar. 4, 2004

(30) Foreign Application Priority Data

Aug. 9, 2002 (JP) ..... 2002-234070

(51) Int. Cl.[7] ..... H01P 1/36; H01P 1/383

(52) U.S. Cl. ..... 333/24.2; 333/1.1

(58) Field of Search ..... 333/24.2, 1.1; 174/260

(56) References Cited

U.S. PATENT DOCUMENTS 5,923,224 A * 7/1999 Makino et al. ..... 333/1.1
6,580,333 B2 * 6/2003 Hasegawa ..... 333/1.1
6,583,681 B1 * 6/2003 Makino et al. ..... 333/1.1
6,603,369 B2 * 8/2003 Ohira et al. ..... 333/1.1
6,670,862 B2 * 12/2003 Masuda ..... 333/1.1
6,677,537 B2 * 1/2004 Kawanami ..... 174/260
6,690,248 B2 * 2/2004 Kawanami ..... 333/24.2
6,710,671 B1 * 3/2004 Tanaka ..... 333/1.1
6,710,672 B2 * 3/2004 Hasegawa ..... 333/1.1
6,768,392 B2 * 7/2004 Makino et al. ..... 333/1.1
6,798,311 B2 * 9/2004 Hasegawa ..... 333/24.2

FOREIGN PATENT DOCUMENTS

JP 11-214212 8/1999

* cited by examiner

*Primary Examiner*—Patrick Wamsley
(74) *Attorney, Agent, or Firm*—Brinks Hofer Gilson & Lione

(57) ABSTRACT

A nonreciprocal circuit element includes a magnetic assembly including a ferrite magnetic body, a common electrode, and three central conductors; capacitors connecting to the respective central conductors; a permanent magnet which applies a DC bias magnetic field to the magnetic body; and a metal case which accommodates the magnetic assembly, the capacitors, and the permanent magnet, the metal case functioning as a magnetic yoke. The saturation magnetic flux density of at least a portion of the metal case and the residual magnetic flux density of the permanent magnet have negative temperature coefficients. Moreover, the portion of the metal case is composed of a magnetic material having a larger absolute value of the temperature coefficient of the saturation magnetic flux density than the absolute value of the temperature coefficient of the residual magnetic flux density of the permanent magnet in the range of −35° C. to +85° C.

6 Claims, 9 Drawing Sheets

NONRECIPROCAL CIRCUIT ELEMENT HAVING EXCELLENT SIGNAL TRANSMISSION EFFICIENCY AND COMMUNICATION APPARATUS USING SAME

BACKGROUND OF THE INVENTION

1. Field of the Invention

The present invention relates to nonreciprocal circuit elements, such as isolators and circulators, used for communication apparatuses, such as mobile phones.

2. Description of the Related Art

Lumped-constant isolators are high-frequency components which allow signals to pass in the transmission direction without any loss and prevent signals from passing in the reverse direction, and are used for transmission circuits of mobile communication apparatuses, such as mobile phones. FIG. 10 is an assembly view showing the structure of such an isolator.

A conventional isolator 100 shown in FIG. 10 includes a magnetic assembly 110 including a magnetic body 104 composed of yittrium-iron-garnet (YIG) and a central conductor 105; a capacitor substrate 120 connected to the central conductor 105; and a permanent magnet 130, all of which are stored in an upper metal case 141 and a lower metal case 142 which also function as magnetic yokes. A DC bias magnetic field is applied to the magnetic assembly 110 by the permanent magnet 130. The conventional isolator 100 is approximately 5 by 5 mm square when used for a small mobile communication apparatus, such as a mobile phone.

The central conductor 105 includes a common electrode (not shown in the drawing) provided along the lower surface of the magnetic body 104, a first central conductor 106, a second central conductor 107, and a third central conductor 108, the central conductors 106, 107, and 108 extending radially in three directions from the common electrode and being folded along the upper surface of the magnetic body 104. The central conductors 106, 107, and 108 are joined together at the common electrode, which corresponds to a ground section. Although not shown in the drawing, the central conductors 106, 107, and 108 are insulated from each other by insulating sheets at the front surface of the magnetic body 104.

The capacitor substrate 120 is provided with matching capacitors corresponding to the individual ports, which will be described below.

The ends of the three central conductors 106, 107, and 108 protrude laterally from the magnetic body 104 to form the individual ports. Each port is connected to each matching capacitor, and one of the ports is connected to a terminator via the matching capacitor.

In the conventional isolator, the saturation magnetic flux density ($4\pi Ms$) of YIG, which constitutes the magnetic body 104, changes by 24% to 34% in the operating temperature range (specifically, −35° C. to +85° C.), i.e., the saturation magnetic flux density at 85° C. is 24% to 34% lower than that at −35° C. In particular as the temperature increases, the decreasing rate of the saturation magnetic flux density increases. On the other hand, the residual magnetic flux density (Br) of the permanent magnet 130 changes only by 21% to 22%, i.e., the residual magnetic flux density at 85° C. is 21% to 22% lower than that at −35° C.

In the conventional isolator, there is a large difference between the temperature coefficient of the saturation magnetic flux density of the magnetic body 104 and the temperature coefficient of the residual magnetic flux density of the permanent magnet 130. Therefore, although a proper DC bias magnetic field is applied to the magnetic body 104 at low temperatures, as the temperature increases, the decreasing rate of the saturation magnetic flux density of the magnetic body 104 increases, and thereby the residual magnetic flux density of the permanent magnet 130 relatively increases. Consequently, a strong DC bias magnetic field tends to be applied to the magnetic body 104 from the magnetic circuit comprising the magnetic yokes (the upper case 141 and the lower case 142) and the permanent magnet 130. With such a tendency, the isolation peak deviates from the desired value, and the isolation frequency characteristics change, resulting in an increase in the insertion loss and a decrease in signal transmission efficiency.

Additionally, the upper case 141 and the lower case 142 are composed of a material that is substantially pure iron, such as SPCC. The SPCC has a Curie point (Tc) of approximately 727° C. (1,000 K). In a material with a Curie point (Tc) of approximately 1,000 K, the saturation magnetic flux density ($4\pi Ms$) changes only by approximately 1.0%. Therefore, it is not possible to compensate for the difference between the temperature coefficient of the saturation magnetic flux density of the magnetic body 104 and the temperature coefficient of the residual magnetic flux density of the permanent magnet 130.

SUMMARY OF THE INVENTION

It is an object of the present invention to provide a nonreciprocal circuit element having excellent signal transmission efficiency in which insertion loss is prevented by improving the temperature characteristics.

It is another object of the present invention to provide a communication apparatus with superior temperature stability using a nonreciprocal circuit element having excellent signal transmission efficiency in which insertion loss is prevented by improving the temperature characteristics.

In one aspect of the present invention, a nonreciprocal circuit element includes a magnetic assembly, the magnetic assembly including a magnetic body composed of ferrite, a common electrode disposed on one surface of the magnetic body, and three central conductors extending in three directions from the periphery of the common electrode and disposed on the magnetic body; capacitors connecting to the respective central conductors; a permanent magnet which applies a DC bias magnetic field to the magnetic body; and a metal case which accommodates the magnetic assembly, the capacitors, and the permanent magnet, the metal case functioning as a magnetic yoke. The saturation magnetic flux density of at least a portion of the metal case functioning as the yoke and the residual magnetic flux density of the permanent magnet have negative temperature coefficients. Moreover, the portion of the metal case is composed of a magnetic material having a larger absolute value of the temperature coefficient of the saturation magnetic flux density than the absolute value of the temperature coefficient of the residual magnetic flux density of the permanent magnet in the temperature range of −35° C. to +85° C.

That is, the present invention is characterized in that the saturation magnetic flux density of at least a portion of the metal case functioning as the yoke and the residual magnetic flux density of the permanent magnet have negative temperature coefficients, and moreover, the magnetic material (the magnetic material for at least a portion of the magnetic yoke) has a larger absolute value of the temperature coefficient of the saturation magnetic flux density in the temperature range of −35° C. to +85° C. than the absolute value of the temperature coefficient of the residual magnetic flux density of the permanent magnet in the temperature range of −35° C. to +85° C.

In such a nonreciprocal circuit element, in the temperature range (operating temperature range) of −35° C. to +85° C., when the operating temperature is high, the decreasing rate of the residual magnetic flux density of the permanent magnet is small. Even if the decreasing rate of the saturation magnetic flux density of the magnetic body increases, the decreasing rate of the saturation magnetic flux density of the magnetic material in the metal case increases. The DC bias magnetic field applied to the magnetic body from the magnetic circuit comprising the permanent magnet and the magnetic yoke (metal case) is decreased by the effect of the magnetic material. Consequently, the bias magnetic field is prevented from being influenced by a relative increase in the residual magnetic flux density of the permanent magnet, and a proper DC bias magnetic field can be applied to the magnetic body composed of ferrite. On the other hand, when the operating temperature is low, the decreasing rate of the saturation magnetic flux density of the magnetic body is small (i.e., the rate of change in the saturation magnetic flux density is small), and the decreasing rate of the saturation magnetic flux density of the magnetic material is also small (the rate of change in the saturation magnetic flux density is small). Consequently, the residual magnetic flux density of the permanent magnet is not relatively increased, and a proper DC bias magnetic field can be applied to the magnetic body composed of ferrite.

That is, in the nonreciprocal circuit element of the present invention, even if the difference between the temperature coefficient of the residual magnetic flux density of the permanent magnet and the temperature coefficient of the saturation magnetic flux density of the magnetic body composed of ferrite is large in the temperature range of −35° C. to +85° C., the difference in the temperature coefficient is compensated for by the magnetic material used for the metal case functioning as the magnetic yoke. Therefore, a strong DC bias magnetic field can be prevented from being applied to the magnetic body, depending on the operating temperature, thus preventing the deviation of the isolation peak. Thereby, a change in isolation frequency characteristics is prevented.

Consequently, in the nonreciprocal circuit element of the present invention, the temperature characteristics can be improved, and thereby, the change in the insertion loss with temperature is decreased, resulting in an improvement in signal transmission efficiency. In the nonreciprocal circuit element of the present invention, by forming at least a portion of the metal case using the magnetic material, the difference in the temperature coefficient between the permanent magnet and the magnetic body can be compensated for. Therefore, a permanent magnet and a magnetic body having a large difference in the temperature coefficient can be used, and the material selectivity of the permanent magnet and the magnetic body is enhanced. In the nonreciprocal circuit element of the present invention, the same effect as that described above can be shown even if the size is reduced to 5 by 5 mm square.

In the nonreciprocal circuit element of the present invention, the Curie point of the magnetic material is preferably less than 400° C., and more preferably 100° C. to 300° C. In the magnetic material having a Curie point of 400° C. or less, the rate of change in the temperature coefficient of the saturation magnetic flux density is large at −0.19%/° C. or less in the range of approximately −35° C. to +85° C. Therefore, it is possible to effectively prevent an increase in the change of the bias magnetic field with a relative increase in the change of the residual magnetic flux density of the permanent magnet.

In the magnetic material having a Curie point of 100° C. to 300° C., the saturation magnetic flux density changes strongly (−0.52%/° C. to −0.19%/° C.) in the range of approximately −35° C. to +85° C. By using such a magnetic material, when the nonreciprocal circuit element is used in the range of approximately −35° C. to +85° C., even if the difference between the temperature coefficient of the residual magnetic flux density of the permanent magnet and the temperature coefficient of the magnetic body composed of ferrite is large, the difference can be effectively compensated for by the magnetic material.

In the nonreciprocal circuit element of the present invention, preferably, the magnetic material is represented by the formula $(Fe_{1-a}Co_a)_{100-b}Ni_b$, wherein 0 atomic percent$\leqq a \leqq$0.1 atomic percent and 28 atomic percent$\leqq b \leqq$41 atomic percent.

If the magnetic material for the metal case which functions as the magnetic yoke has a composition of $(Fe_{1-a}Co_a)_{100-b}Ni_b$, the Curie point becomes 100° C. to 300° C. Co may be substituted for Fe up to a level of 10%, and by incorporating Co, magnetostriction can be reduced.

In the nonreciprocal circuit element of the present invention, preferably, the metal case which functions as the magnetic yoke includes an upper case and a lower case, and the magnetic material is used for at least a portion of the upper or lower case that is closer to the permanent magnet. Consequently, even if the decreasing rate of the saturation magnetic flux density of the magnetic body is increased at high operating temperatures, the magnetic material easily affects the magnetic circuit including the permanent magnet and the magnetic yoke. The bias magnetic field is prevented from being influenced by a decrease in the DC bias magnetic field from the magnetic circuit to the magnetic body and a relative increase in the residual magnetic flux density of the permanent magnet.

In the nonreciprocal circuit element of the present invention, preferably, the metal case is composed of pure iron or a material that is substantially pure iron, such as SPCC, excluding the portion composed of the magnetic material.

In the nonreciprocal circuit element of the present invention, preferably, the permanent magnet is composed of a hard magnetic material in which the absolute value of the temperature coefficient of the residual magnetic flux density is smaller than the absolute value of the saturation magnetic flux density of the magnetic body composed of ferrite by 20% or more. Consequently, the effect of the present invention is shown remarkably.

In the nonreciprocal circuit element of the present invention, the surface of the metal case may be plated with at least one metal selected from the group consisting of Cu, Ag, Au, and Ni.

In the nonreciprocal circuit element of the present invention, the thickness of the metal case is 120 $\mu$m or less. Consequently, reduction in size and weight is enabled.

In another aspect of the present invention, a communication apparatus includes any one of the nonreciprocal circuit elements described above.

The communication apparatus of the present invention includes the nonreciprocal circuit element of the present invention, in which by improving the temperature characteristics, the change in the insertion loss with temperature is decreased, and signal transmission efficiency is improved. Consequently, it is possible to provide a communication apparatus with superior temperature stability. Even if the size of the nonreciprocal circuit element of the present invention is reduced to 5 by 5 mm square, excellent signal transmission efficiency is shown due to excellent temperature characteristics and a decrease in the change in the insertion loss with temperature. As a result, in accordance with the communication apparatus of the present invention provided with the nonreciprocal circuit element, it is possible to provide a small communication apparatus with superior temperature stability.

DESCRIPTION OF THE PREFERRED EMBODIMENTS

Figure 1A:
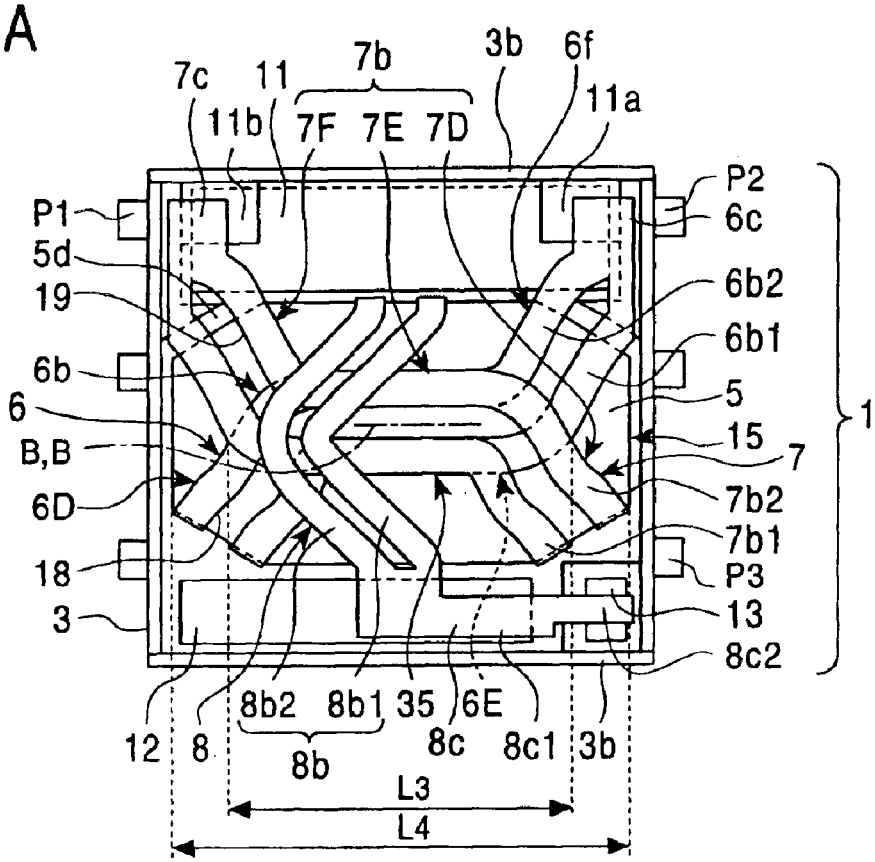
FIG. 1A is a plan view showing a part of an isolator in a first embodiment of the present invention.

FIGS. 1A, 1B, 2, and 3 show a nonreciprocal circuit element used as an isolator in a first embodiment of the present invention.

In an isolator 1 in this embodiment, a magnetic closed circuit is formed by a metal upper case 2 and a metal lower case 3 which function as magnetic yokes. In the magnetic closed circuit included is a permanent magnet (magnet member) 4 which applies a DC bias magnetic field to a magnetic substrate 5, the magnetic substrate (magnetic body) 5 composed of a ferromagnetic material, central conductors 6, 7, and 8, a common electrode 10 connected to the central conductors 6, 7, and 8, capacitor substrates (capacitors) 11 and 12 disposed in the periphery of the magnetic substrate 5, and a terminator 13.

The entire isolator 1 is approximately 3 by 3 mm to 7 by 7 mm square, and preferably 5 by 5 mm square in view of reduction in size. The isolator 1 is operated in the temperature range of −35° C. to +85° C.

The upper case 2 and the lower case 3 are rectangular box-shaped.

The upper case 2, which has a U-shaped cross section, is formed so as to be fitted into the lower case 3, which has a U-shaped cross section. By fitting the openings of the upper case 2 and the lower case 3 into each other, a box-shaped magnetic closed circuit is formed.

One of the upper case 2 and the lower case 3 that is closer to the permanent magnet 4, i.e., the upper case 2 in this embodiment, is composed of a magnetic material which has a larger absolute value of the temperature coefficient ($\alpha 4\pi Ms$) of the saturation magnetic flux density ($4\pi Ms$) than the absolute value of the temperature coefficient of the residual magnetic flux density of the permanent magnet 4 in the temperature range of −35° C. to +85° C. That is, the absolute value of the temperature coefficient of the saturation magnetic flux density of the magnetic material constituting the upper case 2 in the temperature range of −35° C. to +85° C. is larger than the absolute value of the temperature coefficient of the residual magnetic flux density of the permanent magnet 4 in the temperature range of −35° C. to +85° C.

In this embodiment, the material for the permanent magnet 4 has a negative temperature coefficient of the residual magnetic flux density, and the material for the upper case 2 has a negative temperature coefficient of the saturation magnetic flux density.

In this embodiment, as will be described below, the permanent magnet 4 is composed of a hard magnetic material having a temperature coefficient of the residual magnetic flux density of approximately −0.16%/° C. to −0.2%/° C. in the temperature range of −35° C. to +85° C. Consequently, the upper case 2 is composed of a material having a temperature coefficient of the saturation magnetic flux density of −0.19%/° C. to −0.52%/° C. in the temperature range of −35° C. to +85° C.

The temperature coefficient ($\alpha 4\pi Ms$) of the saturation magnetic flux density ($4\pi Ms$) is defined by the following equation.

$$\alpha 4\pi Ms = \Delta 4\pi Ms / (4\pi Ms \cdot \Delta T)$$

In the equation, $\Delta 4\pi Ms$ is a change in $4\pi Ms$ at a temperature difference $\Delta T$.

Consequently, the absolute value of the temperature coefficient of the saturation magnetic flux density is defined by the following equation.

$$|\alpha 4\pi Ms| = |\Delta 4\pi Ms / (4\pi Ms \cdot \Delta T)|$$

In the equation, $\Delta 4\pi Ms$ is a change in $4\pi Ms$ at a temperature difference $\Delta T$.

The Curie point of the magnetic material for the upper case 2 is preferably less than 400° C. In the magnetic material having a Curie point lower than 400° C., the rate of change in the temperature coefficient of the saturation magnetic flux density is large at −0.19%/° C. or less in the range of approximately −35° C. to +85° C. Therefore, it is possible to effectively prevent an increase in the change of the bias magnetic field with a relative increase in the change of the residual magnetic flux density of the permanent magnet.

The Curie point of the magnetic material for the upper case 2 is more preferably 100° C. to 300° C. In the magnetic material having a Curie point of 100° C. to 300° C., the saturation magnetic flux density decreases largely (−0.52%/°

C. to −0.20%/° C.) in the range of approximately −35° C. to +85° C. By using such a magnetic material, when the isolator 1 is used in the range of approximately −35° C. to +85° C., even if the difference between the temperature coefficient of the residual magnetic flux density of the permanent magnet 4 and the temperature coefficient of the magnetic substrate 5 is large, the difference can be effectively compensated for by the magnetic material. The Curie point of the magnetic material for the upper case 2 is most preferably 100° C. to 230° C.

Specific examples of magnetic materials having such temperature characteristics include a magnetic material represented by the formula $(Fe_{1-a}Co_a)_{100-b}Ni_b$. In the Fe-Ni-based or Fe—Co—Ni-based magnetic material, since the Curie point depends on the Ni content, if the composition ratio b for Ni is 28 to 41 atomic percent, the Curie point can be 100° C. to 300° C. If the Ni content exceeds 41 atomic percent, the Curie point increases and the compensation effect for the temperature coefficient is decreased. If the Ni content is less than 28 atomic percent, the Curie point decreases excessively and the compensation effect for the temperature coefficient is increased excessively. The composition ratio b for Ni is more preferably 31 to 36 atomic percent.

The Fe content or the total content of Fe and Co is set at 59 to 72 atomic percent.

Co may be substituted for Fe up to a level of 10%, and by incorporating Co, magnetostriction can be reduced. The Co content exceeding 10%, i.e., the composition ratio a for Co exceeding 0.1, results in an increase in cost, which is disadvantageous.

The lower case 3 is composed of a material that is substantially pure iron, such as SPCC.

Preferably, the front and back surfaces of each of the upper and lower cases 2 and 3 are coated with conductive layers formed, for example, by plating at least one metal selected from the group consisting of Cu, Ag, Au, and Ni.

The thickness of the upper case 2 is approximately 100 to 250 μm, and preferably 120 μm or less in view of reduction in size and weight.

The thickness of the lower case 3 is approximately 100 to 200 μm, and preferably 120 μm or less in view of reduction in size and weight.

Additionally, the upper and lower cases 2 and 3 are not necessarily U-shaped as in this embodiment, and any shape is acceptable as long as a plurality of cases form a box-shaped magnetic closed circuit.

A magnetic assembly 15 including the magnetic substrate 5, three central conductors 6, 7, and 8, and the common electrode 10 is stored in a space enclosed by the upper case 2 and the lower case 3 fitted into each other as described above, i.e., in a magnetic closed circuit comprising the upper case 2 and the lower case 3. That is, the isolator in this embodiment includes the magnetic assembly 15.

Figure 2:
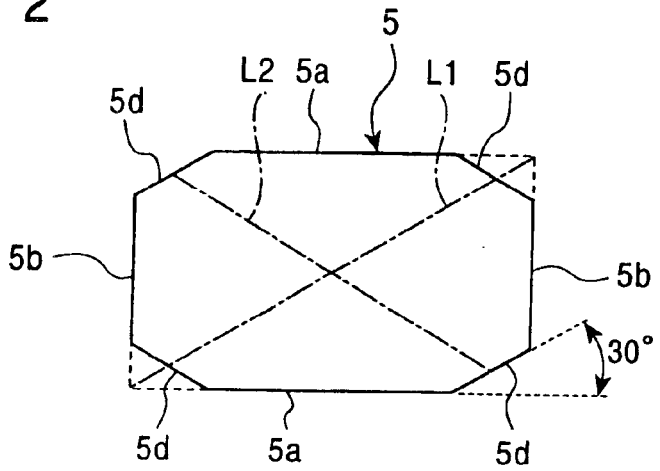
FIG. 2 is a plan view showing an example of a magnetic substrate used in an isolator in accordance with the present invention.

The magnetic substrate 5 is composed of a ferromagnetic material, such as ferrite, and as shown in FIG. 2, the magnetic substrate 5 is substantially rectangular when viewed in plan. More specifically, the substantially rectangular shape consists of long sides 5*a* opposed to each other, short sides 5*b* perpendicular to the long sides 5*a*, and four inclined sides 5*d* which are inclined at an angle of 150° to each long side 5*a*, i.e., which are inclined at an angle of 30° to an extension of each long side 5*a*, and which are individually connected to the short sides 5*b*. Consequently, in each of the four corners of the magnetic substrate 5 when viewed in plan, the inclined surface (abutment) 5*d* is formed, which is inclined at an angle of 150° to each long side 5*a*, i.e., which is inclined at an angle of 120° to each short side 5*b*.

In the magnetic substrate 5, the temperature coefficient of the saturation magnetic flux density is approximately −0.25%/° C. in the temperature range of −35° C. to +85° C. Consequently, in this temperature range, the change in the saturation magnetization is approximately −24% to −32%. Specific examples of the ferrite showing such characteristics include $Y_3Fe_{4.37}Al_{0.57}O_{12}$ and $Y_3Fe_{4.105}Al_{0.83}O_{12}$.

In the magnetic substrate 5, the ratio of the width in the crosswise direction, i.e., in the longitudinal direction, to the width in the lengthwise direction, i.e., in a direction orthogonal to the longitudinal direction, namely, the aspect ratio, is preferably 25% (1:4) to 80% (4:5), namely, the magnetic substrate 5 is long from side to side when viewed in plan.

Although the magnetic substrate 5 shown in FIG. 1 is long from side to side when viewed in plan, the magnetic substrate 5 is longer than is wide when viewed from the side in FIG. 1, i.e., when the drawing is rotated 90 degrees. Therefore, in the present invention, the magnetic substrate 5 may be either long from side to side or longer than is wide.

Figure 3:
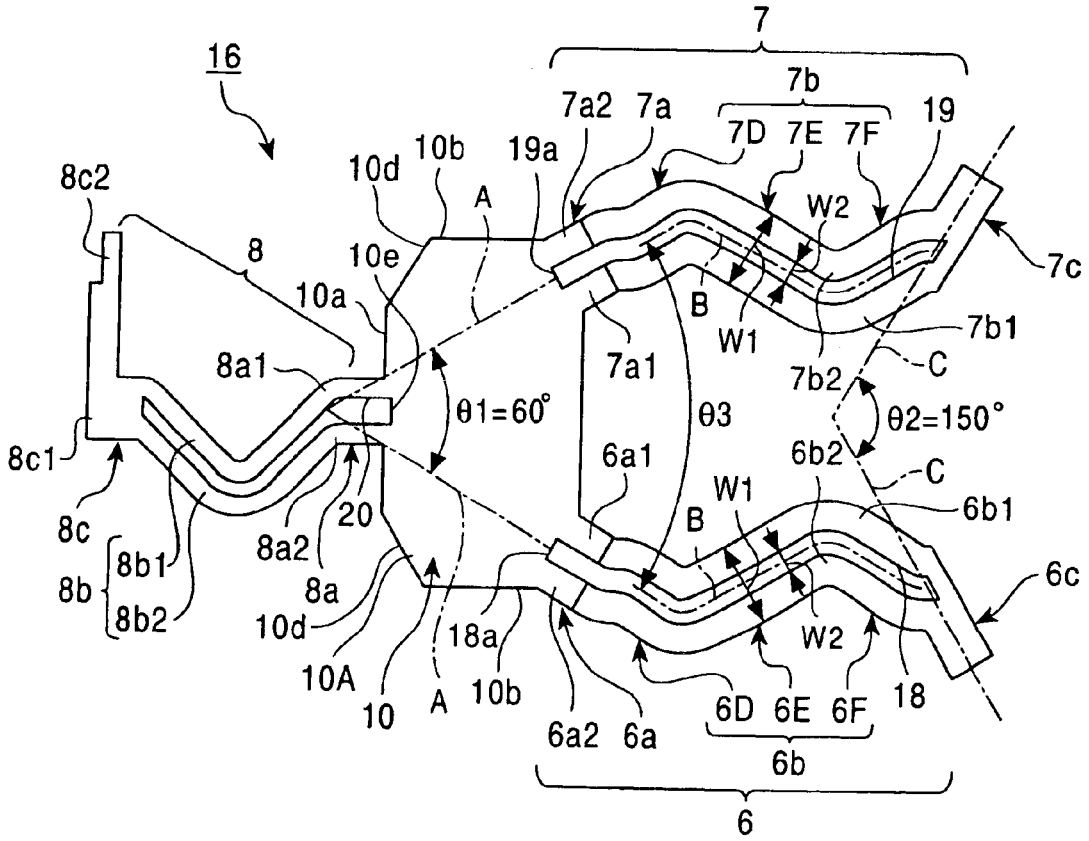
FIG. 3 is a schematic diagram of an electrode unit used for an isolator in accordance with the present invention.

As shown in FIG. 3, which is a schematic diagram, the three central conductors 6, 7, and 8 and the common electrode 10 are integrated, and the three central conductors 6, 7, and 8 and the common electrode 10 mainly constitute an electrode unit 16. The common electrode 10 includes a body 10A which is shaped substantially similar to the magnetic substrate 5 when viewed in plan. That is, the body 10A has substantially a rectangular shape, when viewed in plan, consisting of long sides 10*a* opposed to each other, short sides 10*b* perpendicular to the long sides 10*a*, and four inclined sections 10*d* which are inclined at an angle of 150° to each long side 10*a* and which are inclined at an angle of 120° to each short side 10*b*.

Among the four inclined sections 10*d* at the corners, from two inclined sections 10*d* of one of the long sides, the first central conductor 6 and the second central conductor 7 extend. The first central conductor 6 including a first base conductor 6*a*, a first middle conductor 6*b*, and a first end conductor 6*c* extends from one of the inclined sections 10*d*, while the second central conductor 7 including a second base conductor 7*a*, a second middle conductor 7*b*, and a second end conductor 7*c* extends from the other inclined section 10*d*.

Each of the base conductors 6*a* and 7*a* has the same width as that of the inclined section 10*d* as if the inclined section 10*d* were extended. The angle θ1 between the central axis lines A of the base conductors 6*a* and 7*a* is approximately 60°, as shown in FIG. 3.

The first middle conductor 6*b*, which is corrugated or zigzag when viewed in plan, includes an end 6D adjacent to the base conductor, an end 6F adjacent to the end conductor, and a middle 6E between the ends 6D and 6F. The second middle conductor 7*b*, which has the same shape as that of the first middle conductor 6*b*, includes an end 7D adjacent to the base conductor, an end 7F adjacent to the end conductor, and a middle 7E between the ends 7D and 7F. By forming the first and second middle conductors 6*b* and 7*b* in the shapes described above, the substantial length of each central conductor is increased, and the inductance of each of the middle conductors 6*b* and 7*b* is increased. Consequently, in the nonreciprocal circuit element, both a decrease in frequency and a reduction in size are enabled.

As shown in FIG. 3, the angle θ3 between the central axis lines B of the ends 6D and 7D is substantially the same as or greater than the angle θ1. That is, the ends 6D and 7D extend so as to gradually widen the distance therebetween.

The middles 6E and 7E are formed such that the central axis lines B thereof gradually come close to each other, as shown in FIG. 3.

The angle θ3 between the central axis lines B of the ends 6F and 7F is set to be larger than the angle θ1. That is, the ends 6F and 7F extend so as to gradually widen the distance therebetween, as shown in FIG. 3.

The angle θ2 between the central axis lines C of the end conductors 6*c* and 7*c* is set at approximately 150° or more. That is, the end conductors 6*c* and 7*c* extend so as to gradually widen the distance therebetween.

A slit 18 is formed in the center in the width direction of the first central conductor 6 from the periphery of the common electrode 10 through the base conductor 6*a* and the middle conductor 6*b* to the base of the end conductor 6*c*. Thereby, the middle conductor 6*b* is split into two split conductors 6*b*1 and 6*b*2, and the base conductor 6*a* is also split into two split conductors 6*a*1 and 6*a*2.

A slit 19 is also formed in the center in the width direction of the second central conductor 7. Thereby, the middle conductor 7*b* is split into two split conductors 7*b*1 and 7*b*2, and the base conductor 7*a* is also split into two split conductors 7*a*1 and 7*a*2.

The end of the slit 18 adjacent to the common electrode 10 passes through the base conductor 6*a* and enters the common electrode 10 from the periphery to the position at a certain depth to form a recess 18*a*. Thereby, the line length of the first central conductor 6 is slightly increased. The end of the slit 19 adjacent to the common electrode 10 also passes through the base conductor 7*a* and reaches the periphery of the common electrode 10 to form a recess 19*a*. Thereby, the line length of the second central conductor 7 is slightly increased. Additionally, the recesses 18*a* and 19*a* may be omitted.

On the other hand, the third central conductor 8 extends from the center of the other long side 10*a* of the common electrode 10. The third central conductor 8 includes a third base conductor 8*a* which protrudes from the common electrode 10, a third middle conductor 8*b*, and a third end conductor 8*c*. The third base conductor 8*a* includes two rectangular, split conductors 8*a*1 and 8*a*2 which extend from the center of the long side of the common electrode 10, and a slit 20 is provided between the two split conductors 8*a*1 and 8*a*2.

The third middle conductor 8*b*, which is L-shaped when viewed in plan, includes an L-shaped split conductor 8*b*1 connected to the split conductor 8*a*1 and an L-shaped split conductor 8*b*2 connected to the split conductor 8*b*2. By forming such a curved third middle conductor 8*b*, the substantial length of the central conductor is increased. Consequently, in the nonreciprocal circuit element, both a decrease in frequency and a reduction in size are enabled.

The ends of the split conductors 8*b*1 and 8*b*2 are integrated into the L-shaped third end conductor 8*c*. The third end conductor 8*c* includes a connecting portion 8*c*1 which integrates the split conductors 8*b*1 and 8*b*2 and extends in the same direction as in the split conductors 8*a*1 and 8*a*2, and a connecting portion 8*c*2 which extends substantially perpendicular to the connecting portion 8*c*1.

At the long side 10*a* of the common electrode 10, a recess 10*e* is formed between the split conductors 8*a*1 and 8*a*2 of the third central conductor 8 by partially cutting the long side of the common electrode 10. Thereby, the line length of the third central conductor 8 is slightly increased. Additionally, the recess 10*e* may be omitted as in the recesses 18*a* and 19*a*.

The electrode unit 16 is mounted on the magnetic substrate 5 such that the body 10A of the common electrode 10 is disposed along the back surface (one surface) of the magnetic substrate 5, and the first central conductor 6, the second central conductor 7, and the third central conductor 8 are folded toward the front surface (the other surface) of the magnetic substrate 5. The electrode unit 16 and the magnetic substrate 5 constitute the magnetic assembly 15.

That is, the split conductors 6*a*1 and 6*a*2 of the first central conductor 6 are folded along one of the inclined surfaces 5*d* of the magnetic substrate 5; the split conductors 7*a*1 and 7*a*2 of the second central conductor 7 are folded along another inclined surface 5*d* of the magnetic substrate 5; the split conductors 8*a*1 and 8*a*2 of the third central conductor 8 are folded along the long side 5*a* of the magnetic substrate 5; the middle conductor 6*b* of the first central conductor 6 is disposed along the front surface of the magnetic substrate 5; the middle conductor 7*b* of the second central conductor 7 is disposed along the front surface of the magnetic substrate 5; and the middle conductor 8*b* of the third central conductor 8 is disposed along the center of the front surface of the magnetic substrate 5. Thereby, the electrode unit 16 is mounted on the magnetic substrate 5 to form the magnetic assembly 15.

Since the first and second middle conductors 6*b* and 7*b* have the structures described above, when disposed along the front surface of the magnetic substrate 5, the first and second middle conductors 6*b* and 7*b* intersect with each other on the front surface of the magnetic substrate 5. FIG. 1A shows a case in which the middles 6E and 7E overlap with each other.

In an intersection 35 between the first and second middle conductors 6*b* and 7*b*, the ratio of the length L3 of the overlapping section of the middle conductors to the length L4 of the middle conductors overlying the front surface of the magnetic substrate 5 is 10% or more, and preferably 20% or more. FIG. 1 shows a case in which the ratio of the length L3 of the overlapping section of the middle conductors in the intersection 35 to the length L4 of the middle conductors overlying the front surface of the magnetic substrate 5 is approximately 75%.

It is possible to set the ratio of the length L3 of the overlapping section of the middle conductors 6*b* and 7*b* to the length L4 of the middle conductors overlying the front surface of the magnetic substrate 5 at 100% as the upper limit by changing the shapes, etc., of the first and second central conductors 6 and 7, for example, by changing the angle θ1 between the central axis lines A of the base conductors 6*a* and 7*a*, or by changing the angle θ3 between the central axis lines B of the individual parts of the first and second middle conductors 6*b* and 7*b*.

In the overlapping section, when the middle conductors 6*b* and 7*b* intersect with each other, the crossing angle is preferably 30° or less, and more preferably 15° or less.

In the overlapping section, preferably, the first and second middle conductors 6*b* and 7*b* do not intersect with each other and are substantially parallel to each other.

FIG. 1A shows a case in which the central axis lines B of the middles 6E and 7E are parallel to each other.

Although not shown in FIG. 1A, insulating sheets Z are interposed between the magnetic substrate 5, the first central conductor 6, the second central conductor 7, and the third central conductor 8, and the central conductors 6, 7, and 8 are electrically insulated from each other.

The magnetic assembly 15 is disposed in the center of the bottom of the lower case 3. The capacitor substrates (capacitors) 11 and 12, which are rectangular when viewed in plan, with a thickness about half of the thickness of the magnetic substrate 5 are placed in the bottom of the lower case 3 on both sides of the magnetic assembly 15, and the terminator 13 is placed on one side of the capacitor substrate 12.

The end conductor 6*c* of the first central conductor 6 is electrically connected to an electrode 11*a* formed on one end of the capacitor substrate 11, and the end conductor 7*c* of the second central conductor 7 is electrically connected to an electrode 11*b* formed on the other end of the capacitor substrate 11. The end conductor 8*c* of the third central conductor 8 is electrically connected to the capacitor substrate 12 and the terminator 13. Thereby, the capacitor substrates 11 and 12 and the terminator 13 are connected to the magnetic assembly 15. Additionally, if the terminator 13 is not connected, the circuit element functions as a circulator.

A first port P1 as the nonreciprocal circuit element 1 is formed on the end of the capacitor substrate 11 to which the end conductor 7*c* is connected, and a second port P2 as the nonreciprocal circuit element 1 is formed on the end of the capacitor substrate 11 to which the end conductor 6*c* is connected. A third port P3 as the isolator 1 is formed on the end of the terminator 13 to which the end conductor 8*c* is connected.

Figure 1B:
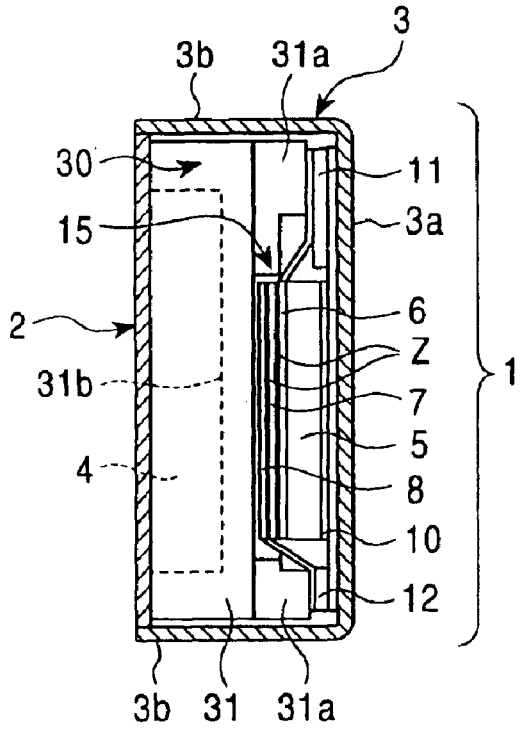
FIG. 1B is a sectional view of the isolator shown in FIG. 1A.

In the space between the lower case 3 and the upper case 2, the magnetic assembly 15 is formed at a thickness that is about half the thickness of the space. In the space above the magnetic assembly 15, a spacer 30 shown in FIG. 1B is placed and the permanent magnet 4 is disposed on the spacer 30. The permanent magnet 4 is composed of a hard magnetic material having a temperature coefficient of the residual magnetic flux density of approximately −0.16%/° C. to −0.2%/° C. in the temperature range of −35° C. to +85° C. Consequently, the absolute value of the temperature coefficient of the residual magnetic flux density of the hard magnetic material is 0.16%/° C. to 0.2%/° C. The permanent magnet 4 is composed of a hard magnetic material in which the absolute value of the temperature coefficient of the residual magnetic flux density is smaller than the absolute value of the saturation magnetic flux density of the magnetic substrate 5 by 20% or more in the temperature range of −35° C. to +85° C. As the hard magnetic material having the temperature characteristics described above, a ferrite magnet or the like may be used.

The spacer 30 includes a base 31, which is rectangular when viewed in plan and which can be placed in the upper case 2, and feet 31*a* provided on the four corners of the bottom of the base 31. A circular storage recess 31*b* is formed on the upper surface of the base 31, i.e., the surface not provided with the feet 31*a*, and a rectangular, transparent hole (not shown in the drawing) which passes through the base 31 is formed on the bottom of the storage recess 31*b*.

The disk-shaped permanent magnet 4 is fitted into the storage recess 31*b*. The spacer 30 provided with the permanent magnet 4 presses the capacitor substrates 11 and 12, the first end conductors 6*c* and 7*c* connected thereto, the terminator 13, and the end of the end conductor 8*c* with the four feet 30*a* toward the bottom of the lower case 3. The magnetic assembly 15 is pressed with the bottom of the spacer 30 toward the bottom of the lower case 3.

In the isolator 1, since the first central conductor 6 and the second central conductor 7 are folded toward the front surface of the magnetic substrate 5, signals inputted from the central conductor on the input side into the magnetic substrate 5 can be transmitted to the output side.

In the isolator 1 in this embodiment, the upper case 2 is composed of a magnetic material which has a larger absolute value of the temperature coefficient of the saturation magnetic flux density than the absolute value of the temperature coefficient of the residual magnetic flux density of the permanent magnet 4 in the temperature range of −35° C. to +85° C. Consequently, in the temperature range of −35° C. to +85° C., when the operating temperature is high, the decreasing rate of the residual magnetic flux density of the permanent magnet 4 is small. Even if the decreasing rate of the saturation magnetic flux density of the magnetic substrate 5 increases, the decreasing rate of the saturation magnetic flux density of the magnetic material constituting the upper case 2 increases. The DC bias magnetic field applied to the magnetic substrate 5 from the magnetic circuit comprising the permanent magnet 4 and the upper and lower cases 2 and 3 is decreased by the effect of the magnetic material. Consequently, the bias magnetic field is prevented from being influenced by a relative increase in the residual magnetic flux density of the permanent magnet 4, and a proper DC bias magnetic field can be applied to the magnetic substrate 5.

On the other hand, when the operating temperature is low, the decreasing rate of the saturation magnetic flux density of the magnetic substrate 5 is small, and the decreasing rate of the saturation magnetic flux density of the magnetic material is also small. Consequently, the residual magnetic flux density of the permanent magnet 4 is not relatively increased, and a proper DC bias magnetic field can be applied to the magnetic substrate 5.

Accordingly, in the isolator 1 in this embodiment, since the temperature characteristics are improved, a strong DC bias magnetic field can be prevented from being applied to the magnetic body, depending on the operating temperature, thus preventing the deviation of the isolation peak. Thereby, a change in isolation frequency characteristics is prevented. As a result, in the wider temperature range, insertion loss can be decreased, and signal transmission efficiency can be improved.

Figure 4A:
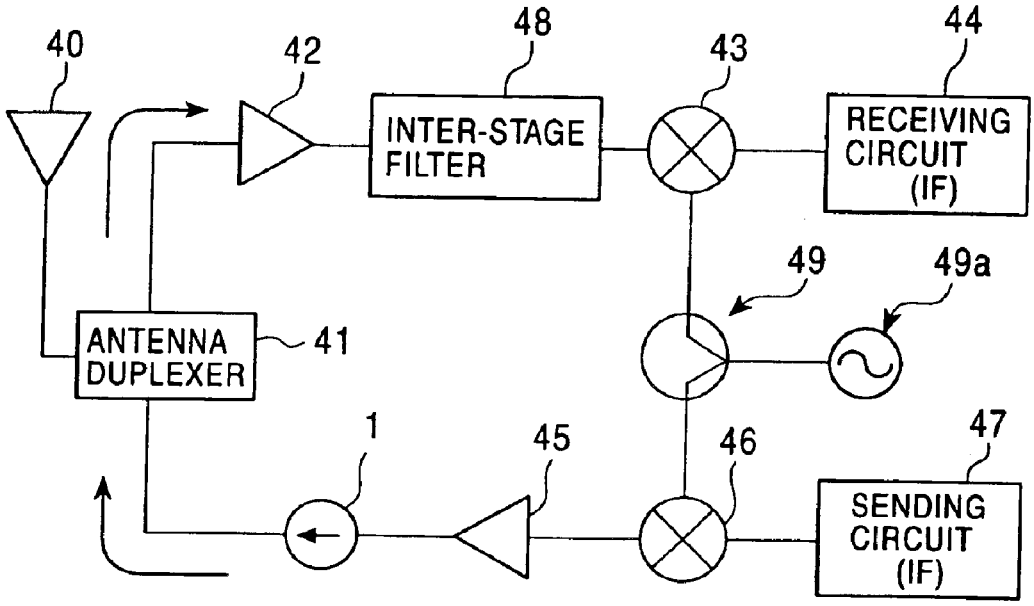
FIG. 4A is a diagram showing an electric circuit including an isolator in accordance with the present invention.

FIG. 4A is a diagram showing an electric circuit of a mobile phone (communication apparatus) in which the isolator 1 in the embodiment described above is incorporated. In this electric circuit, an antenna duplexer 41 is connected to an antenna 40, and a receiving circuit (IF circuit) 44 is connected to the output side of the antenna duplexer 41 via a low-noise amplifier 42, an inter-stage filter 48, and a selective circuit (mixer) 43. A sending circuit (IF circuit) 47 is connected to the input side of the antenna duplexer 41 via the isolator 1, a power amplifier 45, and a selective circuit (mixer) 46. A local oscillator 49*a* is connected to the selective circuits 43 and 46 via a distribution transformer 49.

The isolator 1 having the structure described above is incorporated into the circuit of the mobile phone shown in FIG. 4A. The isolator 1 allows signals to pass through toward the antenna duplexer 41 with little loss, but intercepts signals in the reverse direction by increasing loss. Consequently, unnecessary signals, such as noise, are not inputted in the reverse direction toward the amplifier 45.

Figure 4B:
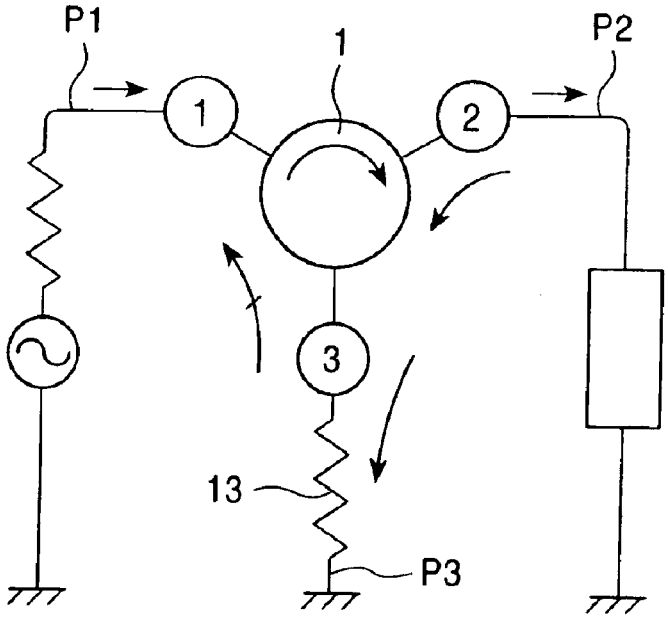
FIG. 4B is a schematic diagram showing the principle of operation of the isolator.

FIG. 4B is a schematic diagram showing the principle of operation of the isolator 1 shown in FIGS. 1A, 1B, 2, and 3. The isolator 1 incorporated into the circuit shown in FIG. 4B transmits signals from a first port P1 to a second port P2, absorbs signals from the second port P2 to a third port P3 by attenuation by the terminator 13, and intercepts signals from the third port P3 to the first port P1.

Consequently, the mobile phone in which the isolator 1 is incorporated into the circuit has superior temperature stability and high reliability.

Figure 5:
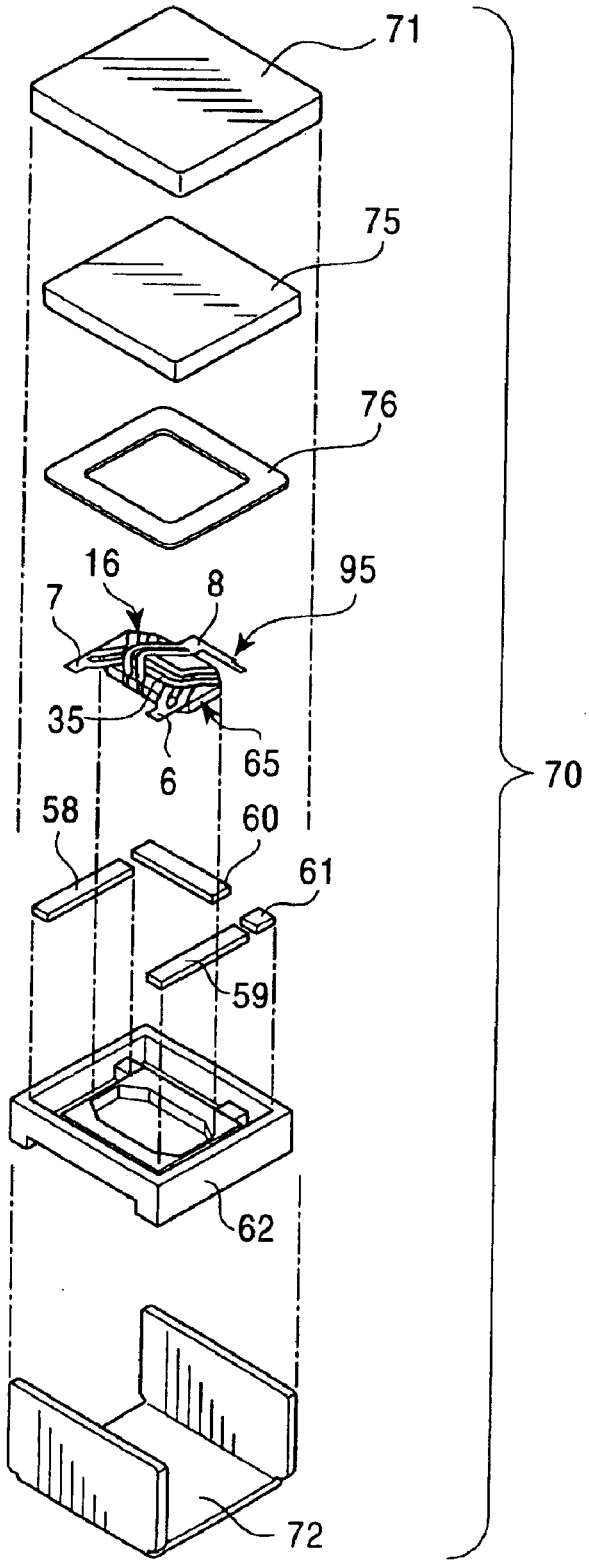
FIG. 5 is an assembly view showing an isolator in a second embodiment of the present invention.

FIG. 5 is an assembly view showing a nonreciprocal circuit element used as an isolator in a second embodiment of the present invention. In an isolator 70 in this embodiment, in a magnetic closed circuit comprising an upper case 71 and a lower case 72 which function as magnetic yokes, i.e., between the upper case 71 and the lower case 72, are enclosed a rectangular permanent magnet 75, a spacer 76, a magnetic assembly 95, capacitor substrates (capacitors) 58, 59, and 60, a terminator 61, and a resin case 62 accommodating these components. The upper case 71 is composed of the same material as that for the upper case 2 in the first embodiment. The lower case 72 is also composed of the same material as that for the lower case 3 in the first embodiment. The permanent magnet 75 is composed of the same material as that for the permanent magnet 4 in the first embodiment.

In the magnetic assembly 95, an electrode unit 16, which is similar to the electrode unit 16 in the first embodiment, is folded around a magnetic substrate 65 which is substantially rectangular when viewed in plan. The magnetic substrate 65 has substantially the same shape as that of the magnetic substrate 5 which is long from side to side, but the magnetic substrate 65 is slightly closer to square. The magnetic substrate 65 is composed of the same material as that for the magnetic substrate 5 in the first embodiment.

In the electrode unit 16 folded around the magnetic substrate 65, an end conductor of a first central conductor 6 is electrically connected to an electrode (not shown in the drawing) disposed on the end of the capacitor substrate 59, and an end conductor of a second central conductor 7 is electrically connected to an electrode (not shown in the drawing) disposed on the end of the capacitor substrate 58. An end conductor of a third central conductor 8 is electrically connected to the capacitor substrate 60 and the terminator 61. Thereby, the magnetic assembly 65 is connected to the capacitor substrates 58, 59, and 60 and the terminator 61.

Figure 7:
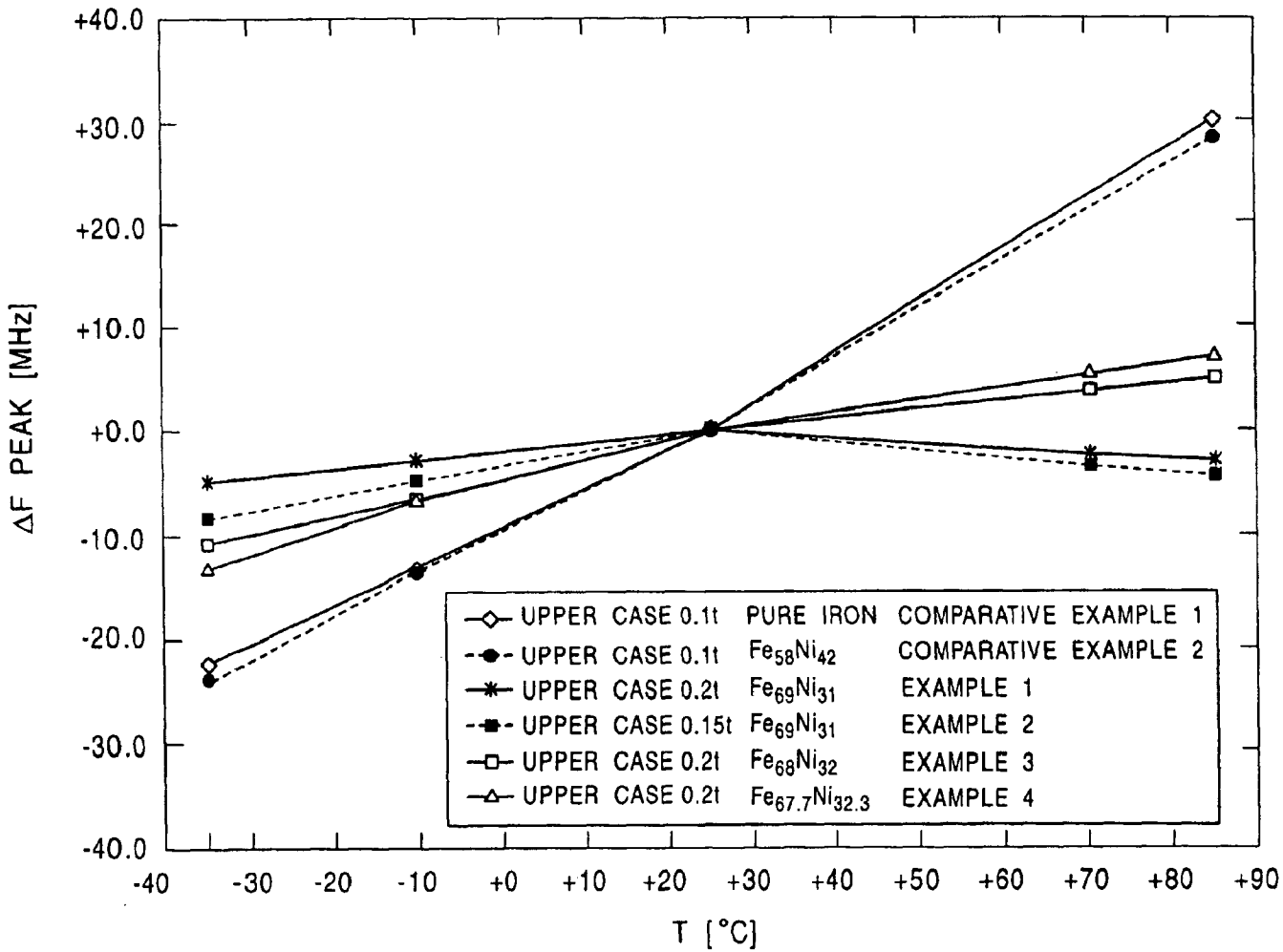
FIG. 7 is a graph showing a relationship between a change in the isolation frequency peak and a temperature with respect to an isolator in each of Examples 1 to 4 and Comparative Examples 1 and 2.

In the isolator 70 shown in FIG. 7, the same effect as that of the isolator 1 in the first embodiment is also obtained.

In the embodiment, although the three central conductors 6, 7, and 8 provided on the magnetic assembly enclosed between the upper and lower cases have the shapes shown in FIGS. 1A, 1B, 2, 3, and 5, the three central conductors may have any other shapes as long as they extend in three directions from the periphery of the common electrode provided along one surface of the magnetic substrate and the central conductors intersect with each other at predetermined angles on the other surface of the magnetic substrate when folded toward the other surface.

Although a case in which the upper case is composed of a magnetic material having a larger absolute value of the temperature coefficient of the saturation magnetic flux density than the absolute value of the temperature coefficient of the residual magnetic flux density of the permanent magnet in the temperature range of −35° C. to +85° C. is described, at least a portion of the upper case may be composed of the magnetic material. When the lower case is closer to the permanent magnet, at least a portion of the lower case may be composed of the magnetic material.

EXAMPLES

The present invention will be described in more details based on the examples. However, it is to be understood that the present invention is not limited to the examples.

Experiment 1

Temperature dependency of each of the residual magnetic flux density of a material for a permanent magnet and the saturation magnetic-flux density of a material for a magnetic substrate in an isolator was investigated. A ferrite magnet was used as the material for the permanent magnet, and $Y_3Fe_{4.37}Al_{0.57}O_{12}$ was used as the material for the magnetic substrate.

Figure 6:
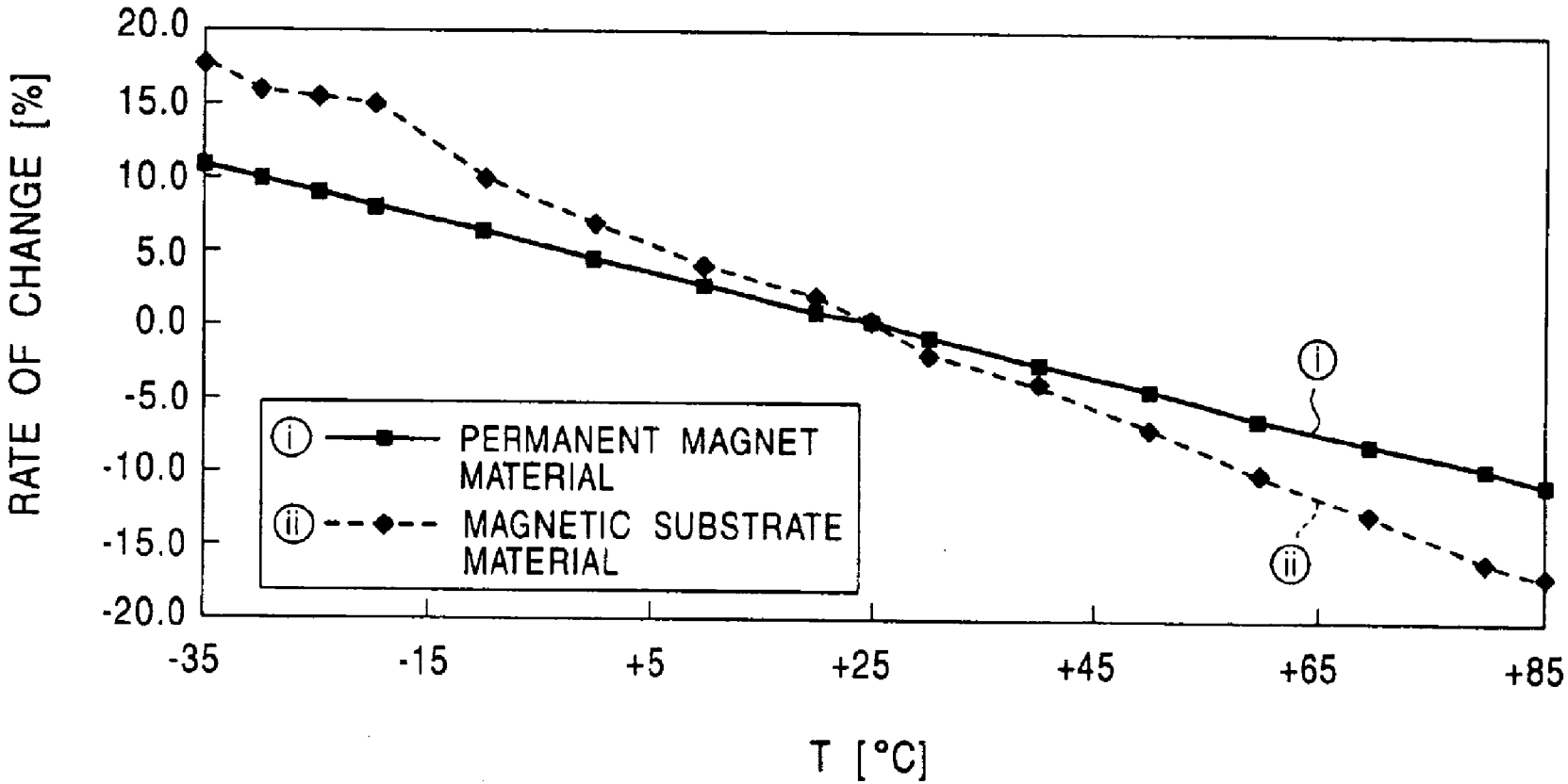
FIG. 6 is a graph showing temperature dependency of each of a permanent magnet material and a magnetic substrate material.

With respect to the temperature characteristics of the saturation magnetic flux density, the saturation magnetic flux density Bs of each material (the residual magnetic flux density Br for the permanent magnet material) was measured when the ambient temperature was varied in the range of −35° C. to +85° C., and the rate of change in the saturation magnetic flux density (the rate of change in the residual magnetic flux density for the permanent magnet material) was checked. The results thereof are shown in FIG. 6. FIG. 6 is a graph showing temperature dependency of each of the permanent magnet material and the magnetic substrate material. The horizontal axis represents ambient temperatures T (° C.), and the vertical axis represents the rate of change ($Bs/Bs_{25}$%) of the saturation magnetic flux density Bs at each temperature to the saturation magnetic flux density $Bs_{25}$ at 25° C. (the rate of change ($Br/Br_{25}$%) of the residual magnetic flux density at each temperature to the residual magnetic flux density at 25° C. for the permanent magnet material). The line (i) represents the temperature characteristics of the residual magnetic flux density of the permanent magnet, and the line (ii) represents the temperature characteristics of the saturation magnetic flux density of the magnetic substrate material.

As is evident from FIG. 6, in the magnetic substrate material, $Y_3Fe_{4.37}Al_{0.57}O_{12}$, the saturation magnetic flux density decreases by 35% in the range of −35° C. to +85° C., i.e., the rate of change ($Bs/Bs_{25}$) at 85° C. is 35% lower than the rate of change ($Bs/Bs_{25}$) at −35° C. In the permanent magnet material, the ferrite magnet, the residual magnetic flux density decreases by 21.6% in the range of −35° C. to +85° C., i.e., the rate of change ($Br/Br_{25}$) at 85° C. is 21.6% lower than the rate of change ($Br/Br_{25}$) at −35° C. Consequently, there is a large difference in temperature characteristics between the magnetic substrate material and the permanent magnet material in the range of −35° C. to +85° C.

Experiment 2

As Example 1, an isolator which was the same as the isolator 1 shown in FIGS. 1 to 3 was prepared except that the upper case 2 was composed of $Fe_{69}Ni_{31}$ with a thickness t of 0.2 mm, the lower case 3 was composed of pure iron with a thickness t of 0.1 mm, the permanent magnet 4 was composed of a ferrite magnet, the magnetic substrate 5 is composed of $Y_3Fe_{4.37}Al_{0.57}O_{12}$, single plate capacitors ($CaTiO_3$-based) manufactured by Nippon Tungsten Co., Ltd. were used as the capacitor substrates 11 and 12, and the desired isolation frequency peak was set at 0.9 GHz.

In the isolator of Example 1, the temperature coefficient of the residual magnetic flux density of the permanent magnet 4 was −0.18%/° C., and consequently, the absolute value of the temperature coefficient was 0.18%/° C. The rate of change in the saturation magnetic flux density of the lower case 3 was −1.0%, i.e., the saturation magnetic flux density at 85° C. was 1.0% lower than the saturation magnetic flux density at −35° C. The temperature coefficient of the saturation magnetic flux density was −0.01%/° C., and consequently, the absolute value of the temperature coefficient was 0.01%/° C. The temperature coefficient of the saturation magnetic flux density of the magnetic substrate 5 was −0.25%/° C., and consequently, the absolute value of the temperature coefficient was 0.25%/° C. The rate of change in the saturation magnetic flux density ($4\pi Ms$) of the upper case 2 was −62%, i.e., the saturation magnetic flux density at 85° C. was 62% lower than the saturation magnetic flux density at 85° C. The temperature coefficient of the saturation magnetic flux was −0.52%/° C., and consequently, the absolute value of the temperature coefficient was 0.52%/° C.

As Example 2, an isolator was prepared as in Example 1 except that the thickness t of the upper case 2 was set at 0.15 mm. In Example 2, the temperature coefficient of the saturation magnetic flux density of the upper case 2 was −0.52%/° C., and consequently, the absolute value of the temperature coefficient was 0.52%/° C.

As Example 3, an isolator was prepared as in Example 1 except that the upper case 2 was composed of $Fe_{68}Ni_{32}$ with a thickness t of 0.2 mm, and the lower case 3 was composed of pure iron with a thickness t of 0.1 mm.

As Example 4, an isolator was prepared as in Example 1 except that the upper case 2 was composed of $Fe_{67.7}Ni_{32.3}$ with a thickness t of 0.2 mm, and the lower case 3 was composed of pure iron with a thickness t of 0.1 mm.

As Comparative Example 1, an isolator was prepared as in Example 1 except that the upper case 2 was composed of pure iron with a thickness t of 0.1 mm, and the lower case 3 was composed of pure iron with a thickness t of 0.1 mm. In the upper and lower cases 2 and 3 in Comparative Example 1, the temperature coefficient of the saturation magnetic flux density was −0.01%/° C., and consequently, the absolute value of the temperature coefficient was 0.01%/° C.

As Comparative Example 2, an isolator was prepared as in Example 1 except that the upper case 2 was composed of $Fe_{58}Ni_{42}$ (42 alloy), and the lower case 3 was composed of pure iron with a thickness t of 0.1 mm. In the isolator in Comparative Example 2, the temperature coefficient of the saturation magnetic flux density of the upper case 2 was −0.11%/° C., and consequently, the absolute value of the temperature coefficient was 0.11%/° C.

The temperature characteristics of the isolation frequency of each of the isolators in Examples 1 to 4 and Comparative Examples 1 to 2 were investigated.

With respect to the temperature characteristics of the isolation frequency, the peak of the isolation frequency (F) of each isolator was measured when the ambient temperature was varied in the range of −35° C. to +85° C., and the amount of change (ΔF) in the isolation frequency was investigated. The results thereof are shown in Table 1 and FIG. 7. In the graph shown in FIG. 7, the horizontal axis represents ambient temperatures T (° C.), and the vertical axis represents the difference (ΔF) between the isolation frequency peak at 25° C. and the isolation frequency peak at each temperature.

TABLE 1

| | ΔF(MHz) | | | | |
|---|---|---|---|---|---|
| | −35° C. | −10° C. | +25° C. | +70° C. | +85° C. |
| Example 1 | −5.1 | −3.0 | +0.0 | −2.0 | −2.7 |
| Example 2 | −8.6 | −5.0 | +0.0 | −3.0 | −4.0 |
| Example 3 | −11.2 | −6.8 | +0.0 | +4.2 | +5.5 |
| Example 4 | −13.5 | −7.0 | +0.0 | +5.9 | +7.8 |
| Comparative Example 1 | −23.0 | −13.4 | +0.0 | +22.5 | +30.0 |
| Comparative Example 2 | −23.5 | −13.7 | +0.0 | +21.2 | +28.3 |

As is evident from FIG. 7 and Table 1, with respect to the isolator in Comparative Example 1 in which both the upper and lower cases are composed of pure iron, the difference (ΔF) changes in the range of −23.0 to +30.0. With respect to the isolator in Comparative Example 2 in which the upper case is composed of $Fe_{58}Ni_{42}$, the difference (ΔF) changes in the range of −23.5 to +28.3. Consequently, the isolators in Comparative Examples 1 and 2 show unsatisfactory temperature characteristics of the isolation frequency peak.

In contrast, with respect to the isolator in Example 2, the difference (ΔF) changes in the range of −8.6 to 0, which is smaller than that in Comparative Example 1 or 2, showing satisfactory temperature characteristics of the isolation frequency peak. With respect to the isolator in Example 1 in which the upper case is thicker than Example 2, the difference (ΔF) changes in the range of −5.1 to 0, showing more satisfactory temperature characteristics of the isolation frequency peak.

As is also evident from FIG. 7 and Table 1, with respect to the isolators in Example 3 and 4, the difference (ΔF) at 85° C. is +5.5 and +7.8, respectively, which is smaller than that in Comparative Example 1 or 2, showing satisfactory temperature characteristics of the isolation frequency peak.

Experiment 3

Figure 8:
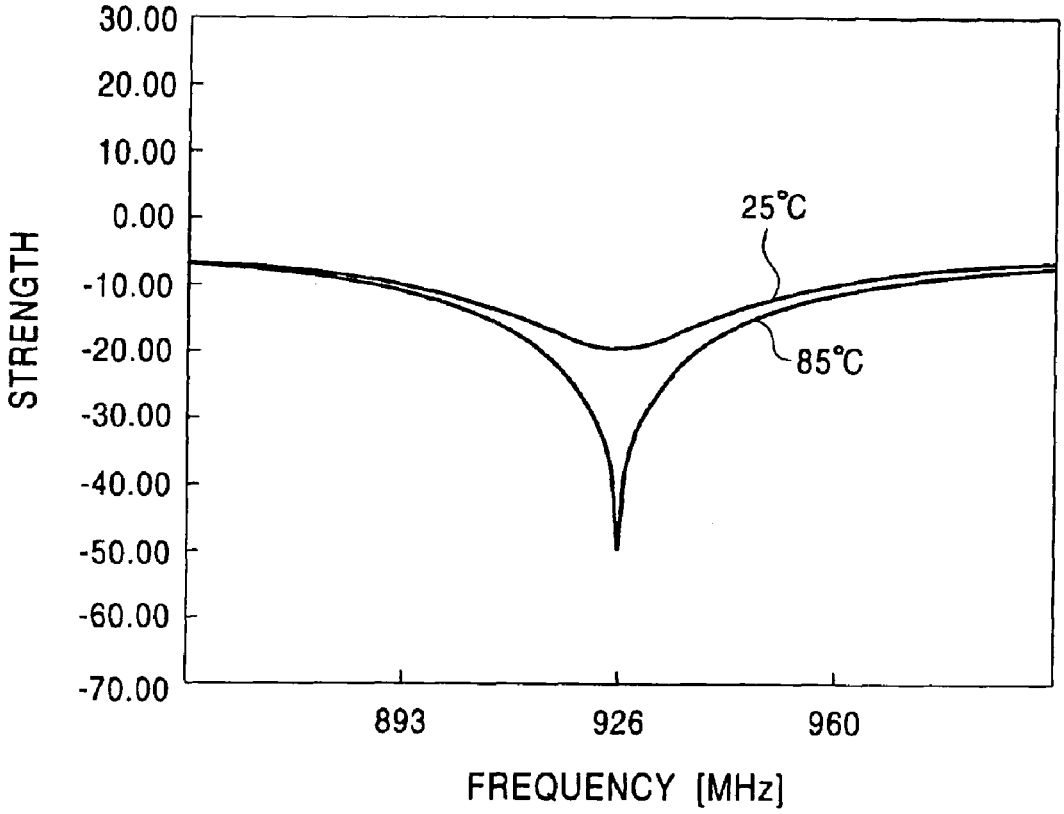
FIG. 8 is a graph showing isolation frequency characteristics of an isolator in Example 1.

The isolation frequency characteristics of the isolator prepared in Example 1 were measured when operated at 25° C. and 85° C. The results thereof are shown in FIG. 8. In order to measure the isolation frequency characteristics, the isolator was placed in a chamber and measurement was carried with a network analyzer after the temperature was stabilized at 25° C. and 85° C., respectively.

As is evident from FIG. 8, with respect to the isolator in Example 1, the frequency peak is in the vicinity of 926 MHz when used at 25° C. and the frequency peak is also in the vicinity of 926 MHz (0.926 GHz) when used at 85° C. Thereby, even if the operating temperature is changed, the deviation of the isolation frequency is small. Consequently, the isolator in Example 1 has improved temperature characteristics, and a change in insertion loss with time is inhibited.

Experiment 4

Figure 9:
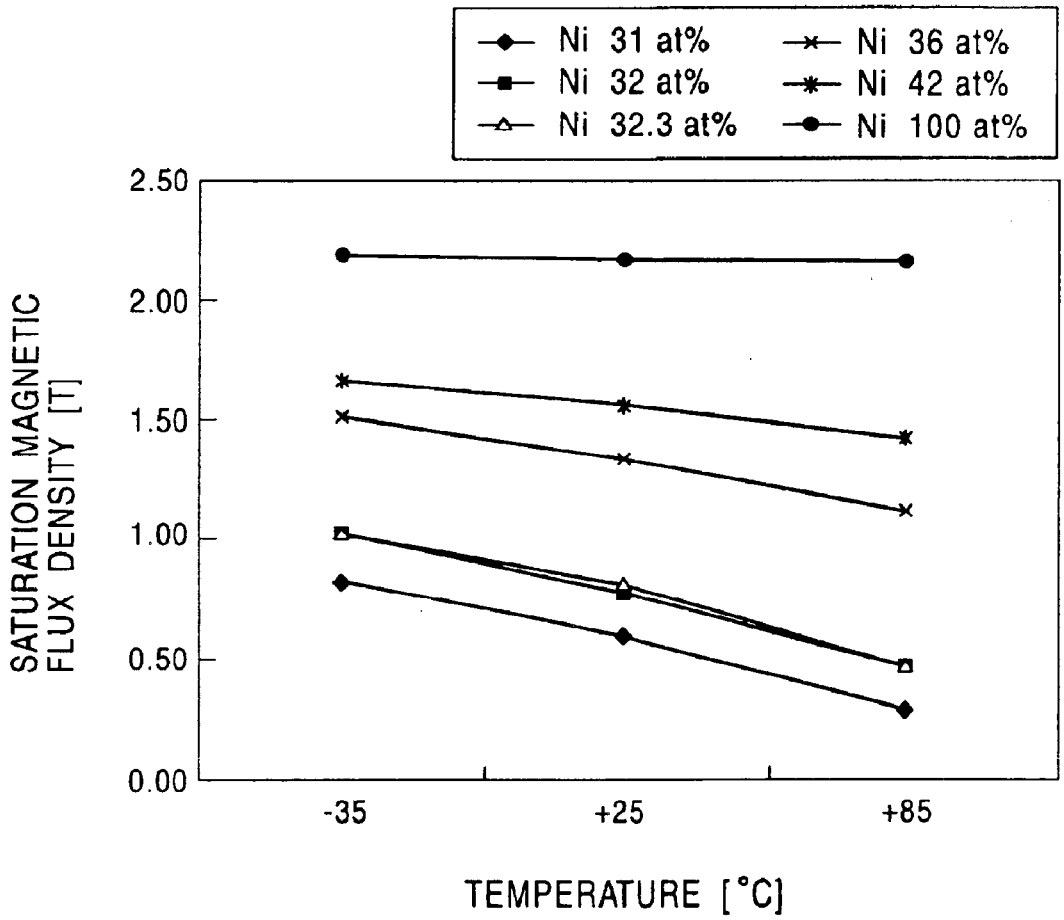
FIG. 9 is a graph showing a relationship between the Ni contents of magnetic materials with a composition of $Fe_{100-b}Ni_b$ and a change in the saturation magnetic flux density with temperature.
Figure 10:
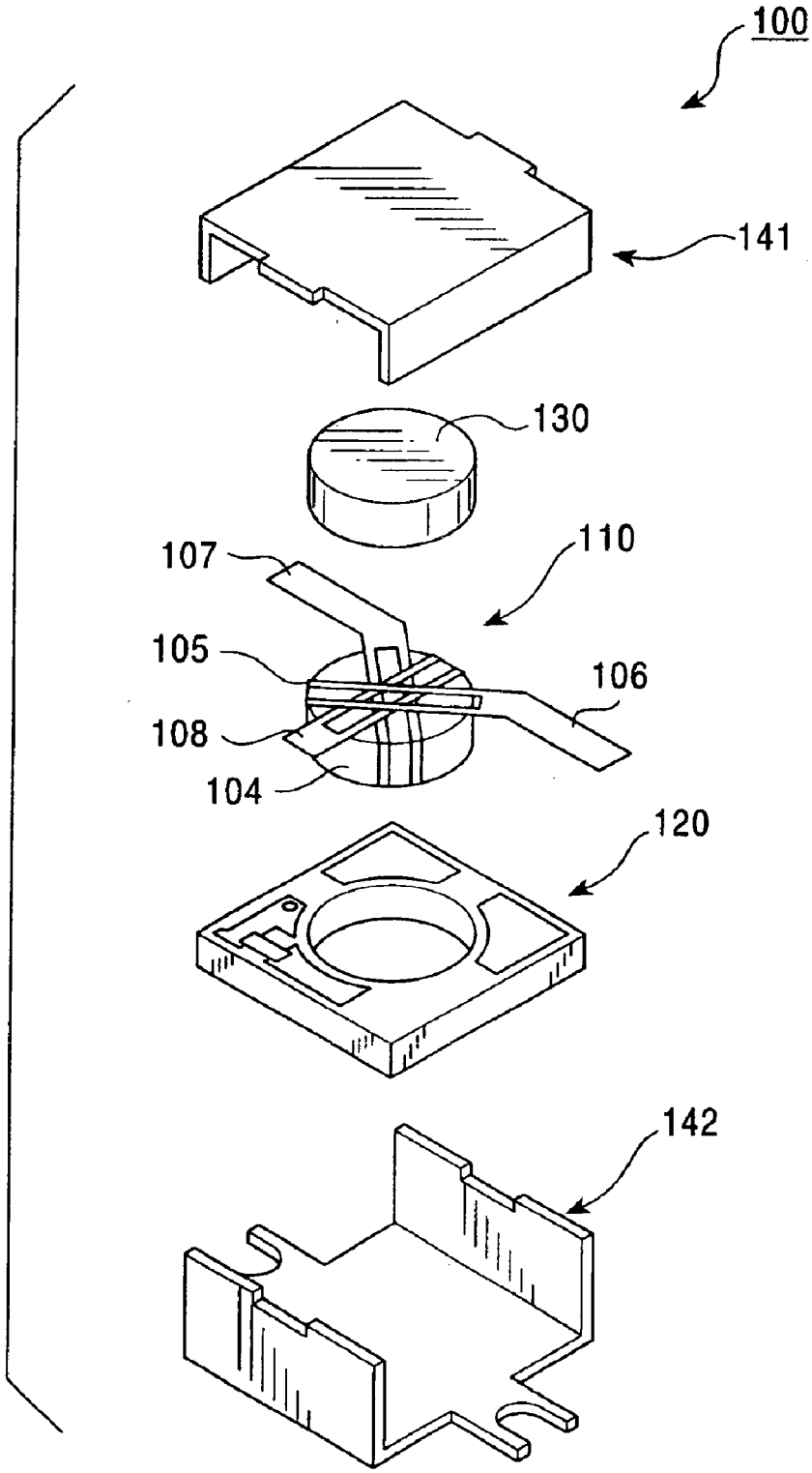
FIG. 10 PRIOR ART
FIG. 10 is an assembly view showing a conventional isolator.

The relationship between the Ni contents (atomic percent) of magnetic materials with a composition of $Fe_{100-b}Ni_b$, the Curie point Tc (° C.), and the change in the saturation magnetic flux density Bs (T) with temperature were investigated. The results thereof are shown in Table 2 and FIG. 9. FIG. 9 is a graph showing the relationship between the Ni contents of magnetic materials with a composition of $Fe_{100-b}Ni_b$ and a change in the saturation magnetic flux density with temperature.

TABLE 2

| Ni content | Saturation magnetic flux density [T] | | | | | Temperature coefficient of saturation magnetic flux density [% /° C.] | Rate of change in saturation magnetic flux density [%] | Curie point Tc |
|---|---|---|---|---|---|---|---|---|
| [at. %] | −35° C. | −30° C. | 25° C. | 80° C. | 85° C. | −35° C. to +85° C. | −35° C. to +85° C. | [° C.] |
| 31 | 0.83 | 0.81 | 0.6 | 0.34 | 0.32 | −0.52 | −61.84 | 100 |
| 32 | 1.02 | 1 | 0.79 | 0.53 | 0.51 | −0.42 | −50.31 | 115 |
| 32.3 | 1.04 | 1.02 | 0.83 | 0.54 | 0.51 | −0.42 | −50.48 | 118 |
| 36 | 1.51 | 1.5 | 1.34 | 1.15 | 1.13 | −0.21 | −25.21 | 230 |
| 42 | 1.67 | 1.66 | 1.57 | 1.45 | 1.44 | −0.11 | −13.73 | 400 |
| 100 | 2.20 | 2.2 | 2.19 | 2.18 | 2.18 | −0.01 | −0.99 | 750 |

As is evident from Table 2 and FIG. 9, in the magnetic material with a composition of $Fe_{100-b}Ni_b$, if the Ni content is less than 42 atomic percent, for example, if the Ni content is 41 atomic percent, the Curie point Tc is considered to be less than 400° C. If the Ni content is 31 atomic percent to 41 atomic percent, the Curie point Tc is considered to be equal to or greater than 100° C. and less than 400° C. If the Ni content is 31 atomic percent to 36 atomic percent, the Curie point Tc is 100° C. to 230° C.

With respect to each magnetic material with a Curie point Tc of equal to or greater than 100° C. and less than 400° C., the rate of change in the saturation magnetic flux density in the range of −35° C. to +85° C. is approximately −61.8% to approximately less than −13.7%. In the magnetic material (Comparative Example 2) with a composition of $Fe_{58}Ni_{42}$ with a Curie point Tc of 400° C., the compensation effect for the bias magnetic field is decreased. As a result, it has been found that in order to obtain the compensation effect for the bias magnetic field, a magnetic material having a Curie point Tc of 230° C. or less is more preferably used.

What is claimed is:

1. A nonreciprocal circuit element comprising:

a magnetic assembly comprising a ferrite magnetic body, a common electrode disposed on one surface of the magnetic body, and three central conductors extending in three directions from a periphery of the common electrode and disposed on the magnetic body;

capacitors connecting to the respective central conductors;

a permanent magnet which applies a DC bias magnetic field to the magnetic body; and a metal case which accommodates the magnetic assembly, the capacitors, and the permanent magnet, the metal case functioning as a magnetic yoke, wherein a saturation magnetic flux density of at least a portion of the metal case and a residual magnetic flux density of the permanent magnet have negative temperature coefficients, and the portion of the metal case comprises a magnetic material having a larger absolute value of the temperature coefficient of the saturation magnetic flux density than an absolute value of the temperature coefficient of the residual magnetic flux density of the permanent magnet in a temperature range of −35° C. to +85° C.

2. A nonreciprocal circuit element according to claim 1, wherein a Curie point of the magnetic material is less than 400° C.

3. A nonreciprocal circuit element according to claim 1, wherein a Curie point of the magnetic material is 100° C. to 300° C.

4. A nonreciprocal circuit element according to claim 1, wherein the magnetic material is represented by the formula $(Fe_{1-a}Co_a)_{100-b}Ni_b$, wherein 0 atomic percent $\leqq a \leqq 0.1$ atomic percent and 28 atomic percent $\leqq b \leqq 41$ atomic percent.

5. A nonreciprocal circuit element according to claim 1, wherein the metal case comprises an upper case and a lower case, and at least a portion of the upper or lower case that is closer to the permanent magnet is the portion of the metal case comprising the magnetic material.

6. A communication apparatus comprising a nonreciprocal circuit element according to claim 1.

* * * * *

UNITED STATES PATENT AND TRADEMARK OFFICE

CERTIFICATE OF CORRECTION

PATENT NO. : 6,876,269 B2
DATED : April 5, 2005
INVENTOR(S) : Komai et al.

It is certified that error appears in the above-identified patent and that said Letters Patent is hereby corrected as shown below:

Title page,
Item [57], ABSTRACT,
Line 16, after "—35°" delete "C." and substitute -- C -- in its place.

Column 18,
Line 30, after "—35°" delete "C." and substitute -- C -- in its place.
Line 33, after "100°" delete "C." and substitute -- C -- in its place.

Signed and Sealed this

Twenty-second Day of November, 2005

JON W. DUDAS
*Director of the United States Patent and Trademark Office*